US008342225B2

(12) United States Patent
Fortunato et al.

(10) Patent No.: US 8,342,225 B2
(45) Date of Patent: Jan. 1, 2013

(54) CONNECTOR FOR A BLIND ASSEMBLY

(75) Inventors: Vito Fortunato, Tullamarine (AU); Ross Lava, Tullamarine (AU); Graeme John Whitty, South Springvale (AU)

(73) Assignee: Damorgold Pty. Ltd. (AU)

( * ) Notice: Subject to any disclaimer, the term of this patent is extended or adjusted under 35 U.S.C. 154(b) by 700 days.

(21) Appl. No.: 11/577,651

(22) PCT Filed: Oct. 24, 2005

(86) PCT No.: PCT/AU2005/001644

§ 371 (c)(1),
(2), (4) Date: Oct. 10, 2007

(87) PCT Pub. No.: WO2006/042377

PCT Pub. Date: Apr. 27, 2006

(65) Prior Publication Data

US 2008/0067278 A1 Mar. 20, 2008

(30) Foreign Application Priority Data

Oct. 22, 2004 (AU) ..... 2004906134

(51) Int. Cl.
*E06B 3/32* (2006.01)
*E06B 9/06* (2006.01)

(52) U.S. Cl. ..... 160/87; 160/120

(58) Field of Classification Search ..... 160/120, 160/181, 185, 241, 368.1, 87, 89; 403/361, 403/383

See application file for complete search history.

(56) References Cited

U.S. PATENT DOCUMENTS

| | | | | |
|---|---|---|---|---|
| 4,127,342 | A * | 11/1978 | Coggiola | 403/243 |
| 4,606,671 | A | 8/1986 | Rasmussen | |
| 4,657,059 | A * | 4/1987 | Clauss | 160/120 |
| 5,938,139 | A | 8/1999 | Lin | |
| 6,843,302 | B2 * | 1/2005 | Nijs | 160/321 |
| 7,051,782 | B2 * | 5/2006 | Nichols et al. | 160/310 |
| 2008/0135191 | A1 * | 6/2008 | Zakowski | 160/181 |

FOREIGN PATENT DOCUMENTS

| | | | |
|---|---|---|---|
| AU | 200189239 | A1 | 5/2002 |
| DE | 3623762 | A * | 1/1988 |
| DE | 4227425 | A1 | 3/1994 |
| DE | 19546203 | C1 | 3/1997 |
| EP | 0863290 | B1 | 9/1998 |
| GB | 2181475 | A | 4/1987 |

* cited by examiner

*Primary Examiner* — Katherine W Mitchell
*Assistant Examiner* — Jeremy Ramsey
(74) *Attorney, Agent, or Firm* — Woodard, Emhardt, Moriarty, McNett & Henry LLP

(57) ABSTRACT

A connector for a multiple element blind assembly includes a first coupling element for association with a first blind element, said first coupling element having a body and a projection extending therefrom. The projection includes a keying portion. Also provided is a second coupling element for association with a second blind element. The second coupling element has a body defining a bore therein, which includes a keyway portion. The keying portion is insertable into and keys with said keyway to a torque transferring portion such that torque applied to one of said coupling elements is transferred to the other coupling element. Also, the keying portion is only insertable into said keyway to said torque transferring portion when said first and second coupling elements are aligned within a single relative rotational range.

18 Claims, 3 Drawing Sheets

CONNECTOR FOR A BLIND ASSEMBLY

CROSS-REFERENCE TO RELATED APPLICATIONS

This application is a National Stage of International Application PCT/AU2005/001644 filed Oct. 24, 2005 (published in English), which claims foreign priority benefits under 35 U.S.C. 119(a)-(d) of Australian Patent Application No. 2004906134 filed Oct. 22, 2004, each of which is hereby incorporated by reference in their entirety.

SUMMARY

The present invention relates to window furnishings, or particularly it relates to a multiple element blind assembly. It will be convenient to describe the invention with particular reference to roller blinds having two or more elements or tubes from which window furnishing fabric is suspended, although it will be appreciated that the invention may have wider application.

Roller blind assemblies are frequently used in decorating windows and providing screening. Roller blinds may consist of one or more coaxially aligned tubes or rods to which a blind drop is fixed and suspended. The blind tube is hung at either end from brackets, which are affixed to structures close to the top of a window, and the blind tube is rotatable relative to the brackets whereby the blind fabric is raised or lowered by being rolled or unrolled around the blind tube. Actuation of the rotational movement of the blind tube may be manual, possibly through a clutch mechanism driven by a chain or cord, or by a drive motor associated with the blind tube. In certain applications, significant widths of window require coverage by blind fabric and it may not be practical to provide a single wide blind to cover that expanse. In such situations two or more drops of blind are provided and each separate drop can be suspended at either end by a bracket and connected through the bracket to adjacent blinds. To avoid the need for each width of blind to have a separate raising and lowering mechanism, adjacent blinds may be linked through brackets so that actuation of a single raising or lowering mechanism can raise several adjacent connected blinds at the one time in unison.

It is highly desirable for the length of adjacent blinds to be the same or at least within a small range of variation, e.g. less than about 10 mm. With currently available blind components, the length of adjacent blinds is then adjusted once the series of blinds is hung, the length of a first blind is set and then the lengths of adjacent blinds are adjusted by rotating the blind tube of each respective blind and then fixing each respective blind tube relative to the next blind. In other words, matching of the lengths of blinds generally occurs on site once at least two blinds are hung, and where the length of one blind can then be referenced and adjusted relative to the next.

Such in situ adjustment may take considerable time, particularly if the length of several adjacent blinds need to be adjusted. Furthermore, in many installation positions, there is only limited room for an installer to access the blind adjustment mechanism. For example, blinds may be installed in a recess or pelmet where there is only limited access and because installation is done overhead and some blinds may be of considerable weight, installation and adjustment may require several installers acting on the one blind at one time.

Even though it may be possible to manufacture blinds of identical length, presently available blind components do not allow for easy installation of multiple roll blinds by a single installer with easy registration of lengths of adjacent blinds.

It would be desirable to provide a coupling for adjacent blinds which facilitates easy installation and accurate registration of adjacent blind lengths without requiring in situ adjustment.

In another aspect of the invention there is provided a multi-roll blind which includes a first coupling element having a projection extending therefrom, and a second coupling element having a bore therein, wherein said projection is insertable into said bore in a torque transferring position, wherein torque applied to either of said coupling elements is transferred to the other coupling element, and wherein said projection is only insertable into said bore to said torque transferring position when said first and second coupling elements are aligned within a single relative rotational range.

The first and second elongate members may be tubular or cylindrical or any other shape known in the art about which roller blind fabric may be rolled. Preferably the elongate members are tubular. Preferably a blind raising/lowering mechanism is associated with the first elongate member at an end remote from the end to which the first coupling element is associated although the raising/lowering mechanism may equally be associated with the second elongate member instead. The length of the elongate members preferably will correspond to the width of the blind drop and fabric which is attached to it. The first coupling element has a projection extending therefrom. Preferably the projection is a shaft substantially coaxial with the axis of the first elongate member. Where the first elongate member is tubular, the first coupling element may have a portion insertable into one end of the elongate member and the projection extends beyond the end of the elongate member.

The second elongate member to which a second blind drop is attached has associated with it the second coupling element. The bore in the second coupling element has a bore therein which is of substantially complementary shape to the projection on the first coupling element. Preferably when the second elongate member is tubular, the second coupling element is insertable into an end of the second elongate member and the bore extends into the elongate member. The bore may include a stop to restrict the extent to which the projection on the first coupling element can extend into the bore.

The projection is insertable into the bore into a torque transferring position wherein if torque is applied to the first elongate member, the torque is transferred to the second elongate member through the first and second coupling elements. Preferably, the projection is substantially cylindrical but with a portion of the cylinder being replaced by a flat face, i.e. in cross-section it constitutes a segment of a circle. The corresponding shape of the bore is cylindrical also but with a portion of the cylindrical surface also having a flat face. Thus, the projection can be inserted into the bore and the flat faces of the projection and bore must be aligned so that rotation of either coupling element will cause the other coupling element similarly to rotate.

It is essential that the shape of the projection and shape of the corresponding bore are such that when the projection can only be inserted into the bore to a torque transferring position within a single relative rotational range. In other words, the projection will only key into the bore along an axis, which may be coaxial with the axis of the first and second elongate members, when the two coupling elements are aligned only in a single orientation. For example, if the relative rotational orientation of the second coupling element can be said to be at 12 o'clock then the projection on the first coupling element can only be inserted into the bore to the transferring position if the first coupling element in similarly aligned to a rotational orientation of about 12 o'clock. It will be appreciated that a limited relative rotational range may be permitted, e.g. the projection may insert into the bore if the first coupling element is arranged somewhere between 11 o'clock and 1 o'clock. More preferably, the angular extent of the relative rotational range is less than about 10°. Using this "clock" analogy, the shape of the projection is such that it will not locate to the torque transferring position at any other relative rotational orientations. For example, if the shape of the bore in transverse section was substantially triangular, a projection having corresponding triangular cross-sectional shape would locate into such a bore at 12 o'clock, 4 o'clock and 8 o'clock, or if the bore was square in cross-section, a corresponding square projection would locate at 12 o'clock, 3 o'clock, 6 o'clock and 9 o'clock. A projection and bore of the present invention will only align to allow insertion to a torque transferring position at when both are aligned at about 12 o'clock. It will be appreciated that there are a range of regular or irregular shapes of projections and corresponding bores which will allow such selective location.

Preferably, the projection is partly insertable into the bore into a locating position wherein the first tube can be rotated relative to the second tube without torque being transferred through the coupling elements. In other words, the projection may partly insert into a vestibule portion of the bore where it does not rotatably engage with the bore. The vestibule portion of the bore may be annular or cylindrical which, unlike the main part of the bore, does not have any flat section to form an interference rotational fit with the flat section of the projection.

Preferably, the extent to which the projection can be inserted into the bore is restricted such that a portion of the projection cannot be inserted into the bore. Preferably the shape of that part of the projection is cylindrical. The projection is preferably insertable through a bracket from which one end of said first and second tubes may be suspended, and the projection is inserted through a bearing in said bracket, such that the portion of the projection which cannot be inserted into the bore is housed within the bearing when the blind is installed. Thus, any tightness or compressing axial force transmitted along the axis of the first and second elongate members will not compress the first and second coupling elements onto the bracket and/or bearing to inhibit rotational movement of the blind about the bracket/bearing.

BRIEF DESCRIPTION OF THE DRAWINGS

It will now be convenient to describe the invention with particular reference to a preferred embodiment shown in the drawings in which.

DETAILED DESCRIPTION OF THE PREFERRED EMBODIMENTS

Figure 1:
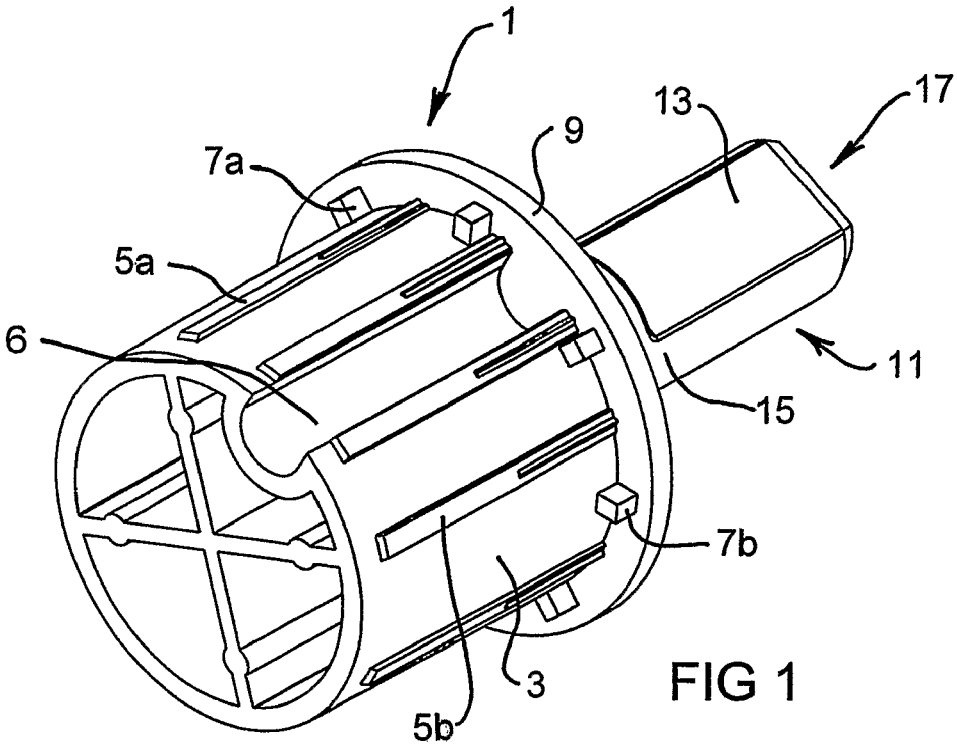
FIG. 1 is a perspective view of a first coupling element of the invention viewed from an end insertable into a blind tube.
Figure 3:
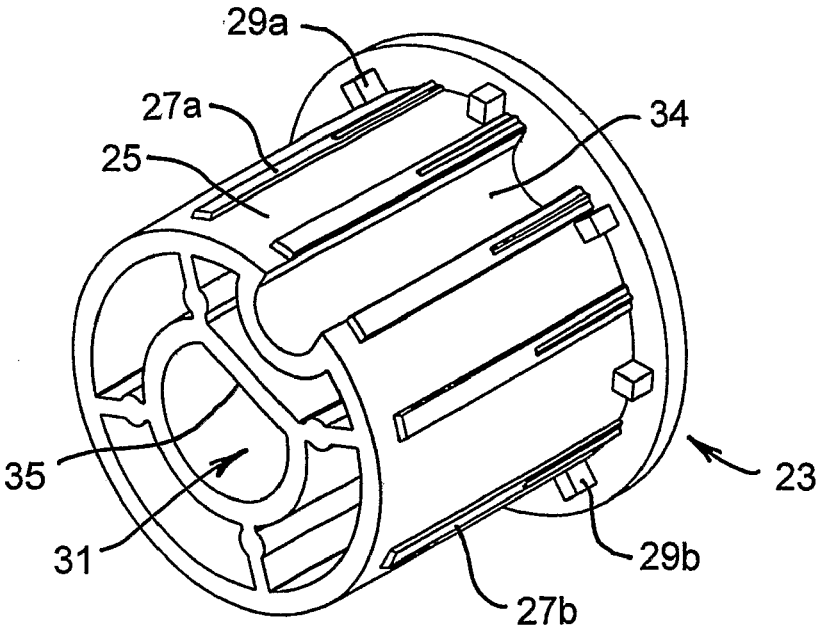
FIG. 3 is a perspective view of the coupling element of FIG. 2 viewed from the side inserted into a blind tube.
Figure 4:
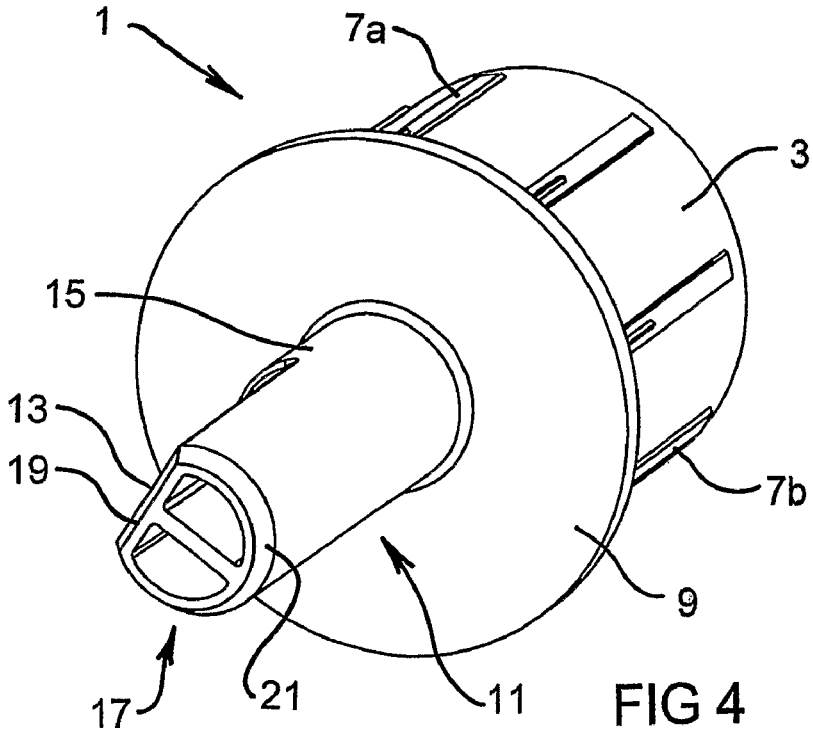
FIG. 4 is a perspective view of a first coupling element of FIG. 1 viewed from the side not inserted into a blind tube.

In FIG. 1, first coupling element constitutes male connector 1 which has a substantially cylindrical body 3 which inserts into one end of a hollow blind tube (not shown). Ridges typically shown as 5*a* and 5*b* create a friction fit with the inside of a blind tube so that male connector 1 is held tightly within the tube. Male connector 1 is inserted into a tube until blocks typically shown as 7*a* and 7*b* abut the end of the tube. Keyway 6 engages with a longitudinal spline on the inside of a blind tube so that torque can be transferred between the coupling element and the tube. Flange 9 comprises an annular disc formed at the end of body 3 beyond which shaft 11 projects. Shaft 11 is coaxial with body 3 and thus once connector 1 is inserted into a blind tube or projection, shaft 11 is thus substantially coaxial also with the blind tube. Shaft 11 is substantially cylindrical but has a flat surface 13 spaced from flange 9. Shaft 11 also has a proximal portion 15 close to flange 9 whose surface is cylindrical. Distal portion 17 of shaft 11 has chamfered surfaces 19 and 21 as seen in FIG. 4 to facilitate easier location of shaft 11 into the bore of the female connector shown in FIGS. 2 and 3.

Female connector 23 includes a body 25 insertable into a blind tube (not shown). The body includes ridges shown typically as 27*a* and 27*b* and blocks 29*a* and 29*b* which function in the same way as ridges 5 and 7 on male connector 1. Female connector 23 has an axial bore 31 which, when female connector 23 is inserted into a blind tube, is substantially coaxial with the axis of that tube. Keyway 34 engages with a longitudinal spline on the inside of a blind tube so that torque can be transferred between the coupling element and the tube.

Figure 2:
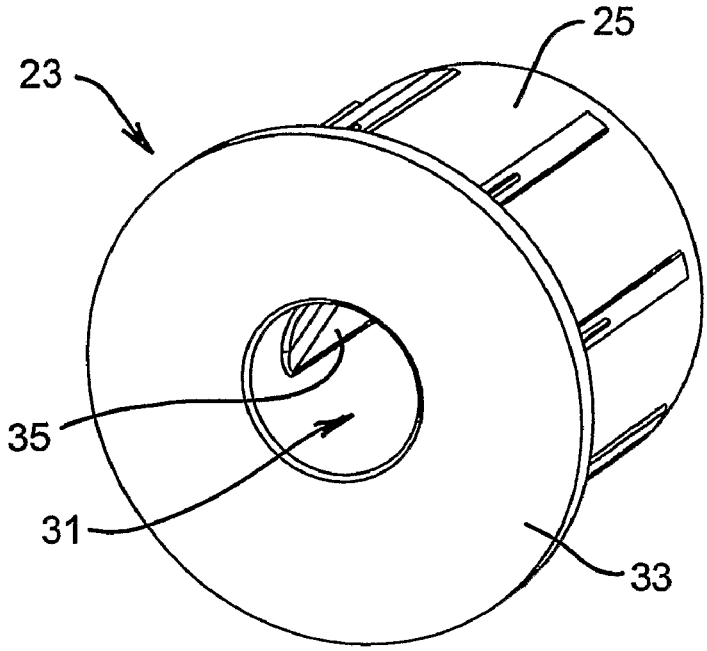
FIG. 2 is a perspective view of a second coupling element of the present invention viewed from the side not inserted into a blind tube.

When so inserted into a tube, flange 33 is substantially the only part of female connector that extends beyond the tube. As can be seen in FIG. 2, axial bore 31 is cylindrical adjacent flange 33 but deeper through the bore it changes shape to include a flat surface 35, so that the shape of bore 31 corresponds to the shape of shaft 11. Thus, when shaft 11 is inserted into bore 31 only to a small extent, male and female connectors 1 and 23 can rotate relative to each other, however once shaft 11 is passed deeper into bore 31 where flat surface 13 and flat surface 35 align, connectors 1 and 23 key into each other so that relative rotation between connectors is not possible, or can only occur to a very limited extent corresponding to the degree of play between shaft 11 and bore 31.

Figure 5:
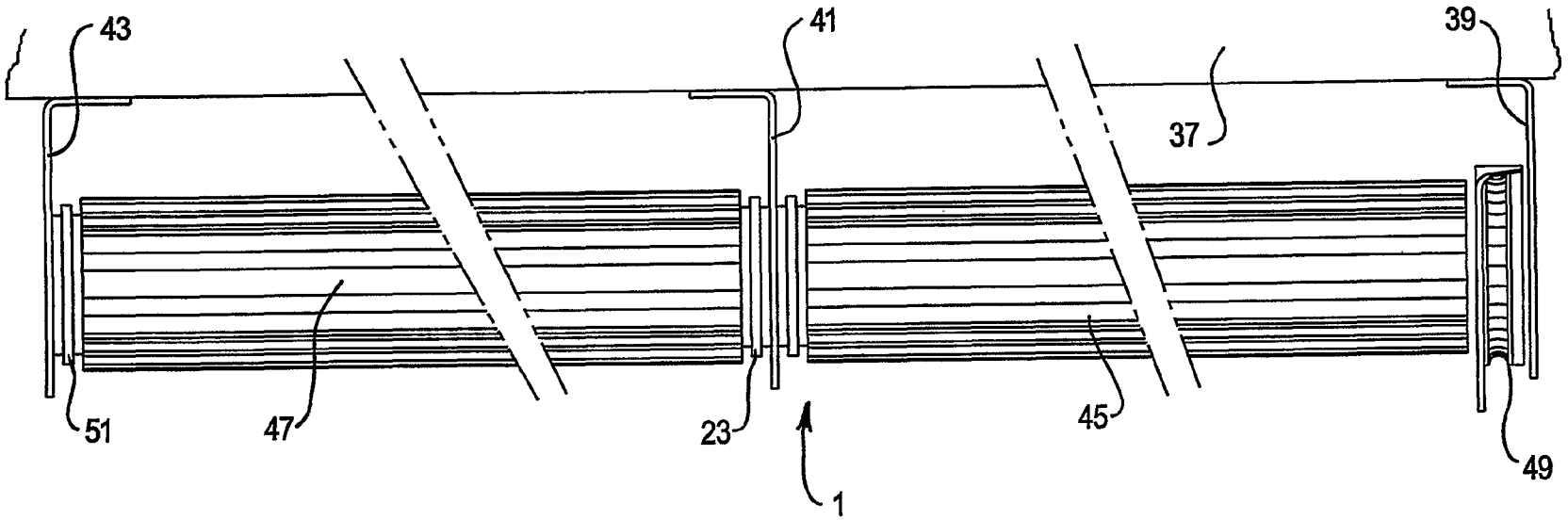
FIG. 5 is a schematic side view of a portion of a multi-roll blind assembly incorporating the present invention.

In FIG. 5 there is shown a representative example of a multi-roll blind as it would appear when fixed in situ to a frame 37. The frame may equally be a ceiling, pelmet, or other part of a building from which a blind is to be hung. Brackets 39, 41 and 43 are fixed to frame 37 and secured using conventional means such as screws and are spaced apart at a predetermined width corresponding to the length of blind tubes 45 and 47, which are shown in FIG. 5 without any blind fabric fixed thereto. At one end of blind tube 45, a clutch 49 has been inserted although this may equally be a motor drive or manually actuated clutch. At the other end of tube 45 there is a male connector 1 inserted therein. Blind tube 45 together with clutch 49 and male connector 1 would normally be hung in bracket 39 and 41 using suitable locking structures. Blind tube 45 with clutch 49 would normally be hung first before any other blind tubes. Once hung, shaft 11 projects to the left through bracket 41. Blind fabric (not shown) would hang from blind tube 45 to a limited extent, most of the blind fabric would be rolled around blind tube 45 when blind tube is installed, i.e. blind tube 45 would be installed with the blind fabric in a rolled up configuration.

Second blind tube 47 can then be installed once blind tube 45 has been suitably fixed. Again, blind fabric (not shown) would be rolled up on blind tube 47. During manufacture the length of drop of blind fabric is precisely determined. To ensure that the drops of fabric on blind tube 45 and 47 match, male connector 1 and female connector 23 have been aligned during manufacture so that if they are similarly aligned on installation, the blind fabric lengths will match. Accordingly, blind tube 45 with female connector 23 at one end can then be initially partially inserted onto male connector 1 and blind tube 47 can then be rotated until the installer detects that flat surfaces 13 and 35 are in alignment then, female connector 23 can be fully inserted onto shaft 11 at which time the blind tubes 45 and 47 will be aligned to the requisite degree. Idle end 51 of blind tube 47 can then be fixed to bracket 43. If a further blind tube is to be located on the left of blind tube 47, then idle end 51 may include its own male connector so that the next blind is fixed in a similar way.

The apparatus may be made from any suitable materials. Preferably, the male and female connectors are made from injection moulded nylon, more preferably including an ultraviolet stabilizer.

It is to be understood that various modifications, additions and/or alterations may be made to the parts previously described without departing from the spirit of the present invention.

The invention claimed is:

1. A multiple element blind assembly connector which connects at least a first blind tube around which a first blind may be wound to a second blind tube around which a second blind may be wound, the connector comprising:

a first coupling element attachable to the first blind tube, said first coupling element having a body and a projection extending therefrom, said projection including a first keying portion having a first interference region;

a second coupling element attachable to the second blind tube, said second coupling element having a body defining a bore therein, which includes a second keying portion having a second interference region;

wherein said first keying portion is insertable into said second keying portion along an insertion axis and upon insertion said first interference region keys with the second interference region of said second keying portion to a torque transferring position such that torque applied to one of said coupling elements is transferred to the other coupling element by interference between one interference region acting on the other interference region, and wherein said first keying portion is only insertable into said second keying portion to said torque transferring position when said first and second coupling elements are aligned within a single relative rotational range along said insertion axis; and wherein said first keying portion is capable of being inserted into and keyed with said second keying portion concurrently with either or both of said blind tubes substantially wound around by their respective blinds.

2. A connector according to claim 1 wherein said first coupling element has a rotational axis and said projection is substantially coaxial with said axis.

3. A connector according to claim 1 wherein said second coupling element has a rotational axis and said bore is substantially coaxial with said axis.

4. A connector according to claim 1 wherein said relative rotational range has an angular extent of less than 45°.

5. A connector according to claim 4 wherein said relative rotational range has an angular extent of less than 10°.

6. A connector according to claim 1 wherein said first keying portion is insertable into said bore to an intermediate locating position in which positions position said one coupling element may be rotated relative to the other coupling element without torque being transferred to the other coupling element.

7. A connector according to claim 6 wherein said torque transferring position is reached by said first keying portion to be inserted into said bore to beyond said intermediate locating position.

8. A connector according to claim 1 wherein said blind assembly includes a bracket from which one end of said first and second blind tubes are suspended wherein said first keying portion of said projection is insertable into said bore through an opening in said bracket.

9. A connector according to claim 1 including a stop means to space one said body from the other said body.

10. A connector according to claim 9 wherein said step stop means includes a step formed on said projection and a corresponding abutment surface in said bore.

11. A connector according to claim 1 wherein said first keying portion and said second keying portion include a facet which allows said first keying portion to key with said second keying portion in only one relative rotational orientation.

12. A connector according to claim 1 wherein said first keying portion and second keying portion include one or more corresponding splines.

13. A connector according to claim 1 wherein said projection includes a chamfer at its end distal from said body.

14. A connector according to claim 1 wherein said first keying portion includes a surface in the shape of part of a cylinder and each second keying portion is substantially cylindrical.

15. A connector according to claim 1 wherein said second keying portion includes a surface in the shape of part of a cylinder.

16. A connector according to claim 1 wherein each of said coupling elements respectively includes an alignment means for engaging a blind tube in a single relative rotational range, and when said first keying portion is inserted into said second keying portion to said torque transferring position, said blind tubes are aligned to a single relative rotational range.

17. A multi-roll blind comprising:

a first blind tube to which a first blind drop may be attached;

a second blind tube to which a second blind drop may be attached, and a multiple element blind assembly connector comprising:

a first coupling element attachable to the first blind tube, said first coupling element having a body and a projection extending therefrom, said projection including a first keying portion having a first interference region;

a second coupling element attachable to the second blind tube, said second coupling element having a body defining a bore therein, which includes a second keying portion having a second interference region;

wherein said first keying portion is insertable into said second keying portion of the second coupling element along an insertion axis and upon insertion said first interference region keys with the second interference region of said second keying portion to a torque transferring position such that torque applied to one of said coupling elements is transferred to the other coupling element by interference between one interference region acting on the other interference region, and wherein said first keying portion is only insertable into said second keying portion to said torque transferring position when said first and second coupling elements are aligned within a single relative rotational range along said insertion axis; and wherein said first keying portion is being capable of being inserted into and keyed with said second keying portion concurrently with either or both of said blind tubes substantially wound around by their respective blinds.

18. A multi-roll blind according to claim 17 wherein said first and second blind tubes are only capable of being coupled with said connectors with a torque transferring arrangement when aligned in a single relative rotational range.

* * * * *